US005595049A

United States Patent [19]

Leifeld

[11] Patent Number: 5,595,049

[45] Date of Patent: Jan. 21, 1997

[54] METHOD AND APPARATUS FOR DEPOSITING SLIVER FROM A SLIVER-PRODUCING MACHINE INTO A COILER CAN

[75] Inventor: Ferdinand Leifeld, Kempen, Germany

[73] Assignee: Trützschler GmbH & Co. KG, Mönchengladbach, Germany

[21] Appl. No.: 458,469

[22] Filed: Jun. 2, 1995

[30] Foreign Application Priority Data

Aug. 11, 1994 [DE] Germany ..... 44 28 474.8

[51] Int. Cl.[6] ..... B65B 63/04

[52] U.S. Cl. ..... 53/430; 53/118; 53/473; 19/159 R

[58] Field of Search ..... 19/157, 159 A, 19/159 R, 160; 242/361.4, 361.5, 363; 53/430, 473, 118, 235

[56] References Cited

U.S. PATENT DOCUMENTS

| | | | |
|---|---|---|---|
| 3,498,149 | 3/1970 | Kundrach | 19/157 X |
| 3,703,023 | 11/1972 | Krauss et al. | 19/159 R X |
| 4,400,854 | 8/1983 | Socha | 19/159 R |
| 4,434,532 | 3/1984 | Oehy | 19/159 R |
| 4,443,913 | 4/1984 | Klazar | 19/159 A |
| 4,709,452 | 12/1987 | Cooley et al. | 19/159 R |
| 4,965,912 | 10/1990 | Kluttermann et al. | 19/159 A X |
| 5,237,726 | 8/1993 | Gartenmann et al. | 19/159 A X |
| 5,272,790 | 12/1993 | Demuth et al. | 19/157 X |
| 5,400,476 | 3/1995 | White | 19/159 A X |

FOREIGN PATENT DOCUMENTS

| | | | |
|---|---|---|---|
| 64584 | 11/1982 | European Pat. Off. | 19/159 R |
| 1436029 | 5/1976 | Germany . | |
| 2802216 | 7/1979 | Germany | 19/159 R |
| 3734425 | 3/1989 | Germany . | |
| 4307839 | 9/1994 | Germany . | |
| 967366 | 8/1964 | United Kingdom . | |
| 2265161 | 9/1993 | United Kingdom . | |
| 92/04266 | 3/1992 | WIPO . | |

OTHER PUBLICATIONS

Patent Abstracts of Japan, M–390 Jun. 25, 1985 vol. 9, No. 149 & 60–26578.

*Primary Examiner*—John Sipos
*Assistant Examiner*—Daniel Moon
*Attorney, Agent, or Firm*— Spencer & Frank

[57] ABSTRACT

An apparatus for depositing sliver from a sliver-producing machine into a coiler can includes an arrangement for outputting the sliver by the sliver-producing machine with a delivery speed; a movable coiler can platform for receiving an upwardly open coiler can thereon; a sliver advancing device; a sliver depositing device positioned above the coiler can platform for receiving the sliver from the sliver advancing device and for depositing the sliver into the coiler can in an annular pattern; separate motors for driving the platform, the sliver advancing device and the sliver depositing device; and a lag-setting arrangement for automatically changing a speed lag between the motors upon a change of the delivery speed.

10 Claims, 5 Drawing Sheets

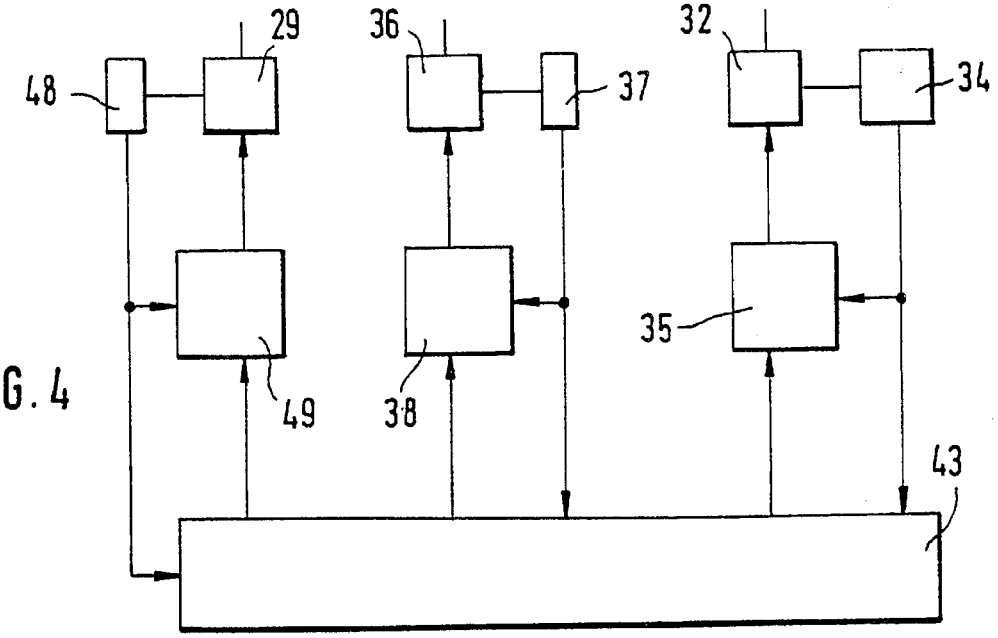
FIG. 4
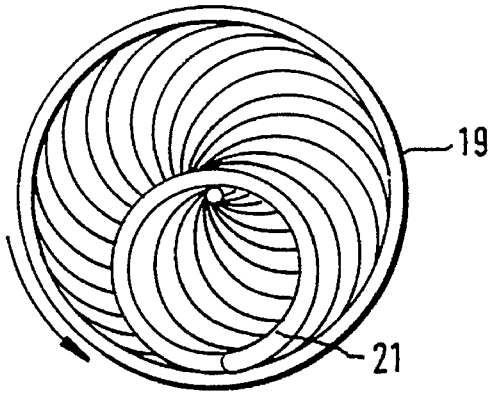
FIG. 5
FIG. 6
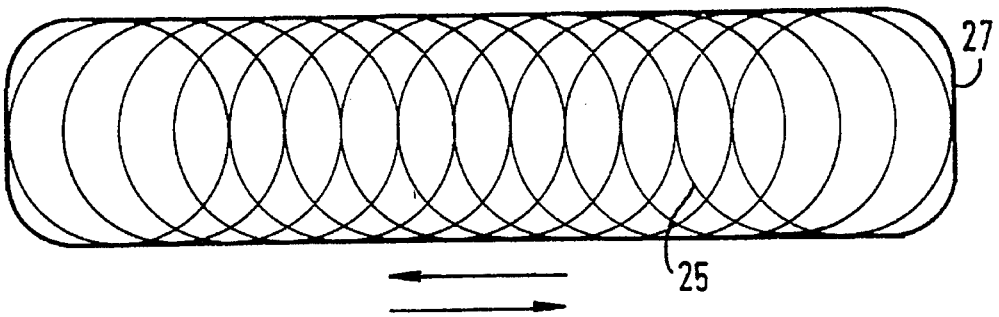

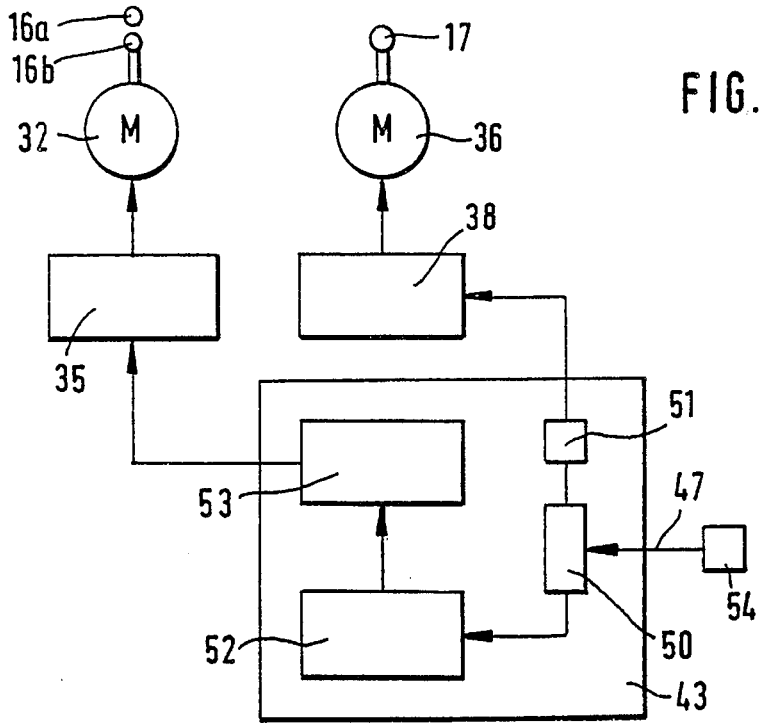
FIG. 7
FIG. 8
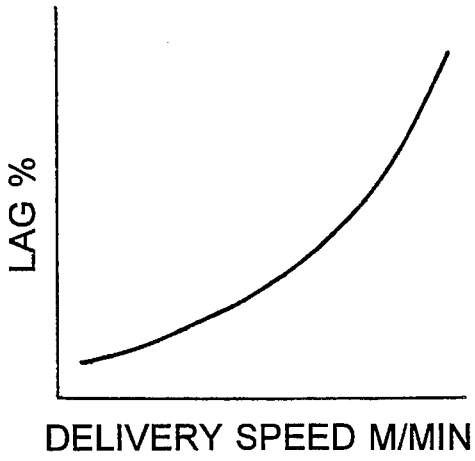
FIG. 9
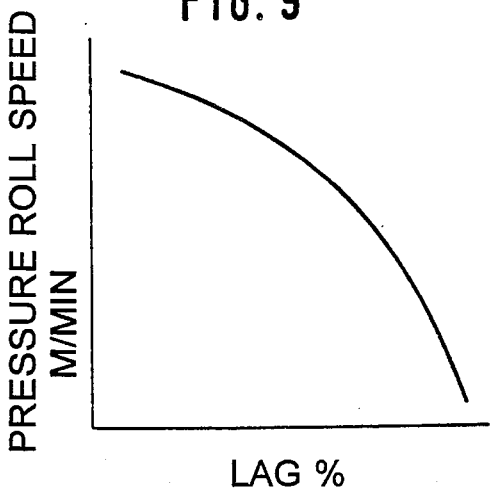
FIG. 10 (PRIOR ART)
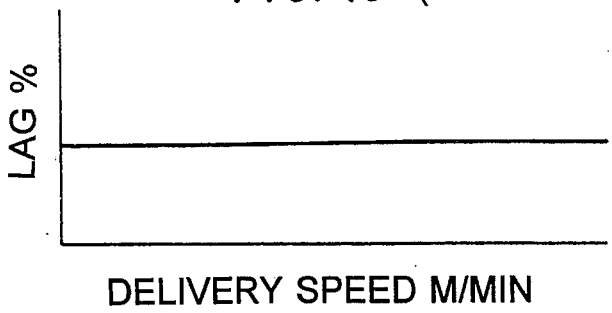

METHOD AND APPARATUS FOR DEPOSITING SLIVER FROM A SLIVER-PRODUCING MACHINE INTO A COILER CAN

CROSS-REFERENCE TO RELATED APPLICATION

This application claims the priority of German Application P 44 28 474.8 filed Aug. 11, 1994, which is incorporated herein by reference.

BACKGROUND OF THE INVENTION

This invention relates to a method and an apparatus for depositing textile sliver into a coiler can from a sliver-producing machine. The apparatus includes a sliver advancing arrangement, such as cooperating pressure rolls, a rotating coiler head for the epicycloidal deposition of the sliver into the coiler can and a platform which supports the coiler can and which moves during the sliver deposition. The pressure rolls, the coiler head and the coiler can platform are each associated with separate drive motors and the rpm ratio between the drive motors is variable.

In a known process, mechanically mutually independent electric motors are provided for driving the pressure rolls which advance the sliver, for driving the coiler head and for driving the can platform. The electric motors are connected in series. It is a disadvantage of this arrangement that the rpm variation is linear. It has been found, however, that at elevated delivery speeds, for example at 900 m/min and above, problems are encountered in the sliver deposition. Further problems occur during sliver deposition at low speeds, for example, during start-up and during braking.

SUMMARY OF THE INVENTION

It is an object of the invention to provide an improved method and apparatus of the above outlined type from which the discussed disadvantages are eliminated and which, in particular, ensures a uniform and disturbance-free sliver deposition into the coiler can even at elevated delivery speeds.

This object and others to become apparent as the specification progresses, are accomplished by the invention, according to which, briefly stated, the apparatus for depositing sliver from a sliver-producing machine into a coiler can includes an arrangement for outputting the sliver by the sliver-producing machine with a delivery speed; a movable coiler can platform for receiving an upwardly open coiler can thereon; a sliver advancing device; a sliver depositing device positioned above the coiler can platform for receiving the sliver from the sliver advancing device and for depositing the sliver into the coiler can in an annular pattern; separate motors for driving the platform, the sliver advancing device and the sliver depositing device; and a lag-setting arrangement for automatically changing a speed lag between the motors upon a change of the delivery speed.

The inventive measures provide for an automatic change of the rpm-lag between the drives for the pressure rolls, the coiler head and the can platform when the sliver output speed of the sliver-producing machine changes. The alteration of the rpm-lags is based on specific characteristic curves as a function of the sliver output speed. In this manner, in the range of lower output speeds low lags are obtained whereas at higher output speeds, for example at 900 m/min and above, higher lags appear. Thus, the high rpm-lag required for the high-speed sliver output is lowered in case of lower sliver output speeds so that, as a result, the sliver is not adversely affected when the running speed is low. Typically the peak velocity of the sliver-producing machine and thus the peak output is increased when the starting speed of the machine is substantially remote from its terminal speed. Accordingly, the increase of the output speed is advantageously made possible by adapting the lags during the rpm change for the various speeds between starting speed and the peak speed.

Particularly in case of sliver deposition into a coiler can of rectangular horizontal outline but also in case of a cylindrical can, upon increased delivery speeds the problems encountered in the sliver deposition are avoided since, according to the invention, the rpm-lags are adapted to the higher sliver delivery speed. Advantages are also achieved at lower delivery speeds which are traversed at each run-up and deceleration step.

In case of relatively small coiler head diameters, centrifugal forces are significantly higher than in case of larger coiler head diameters, given the same sliver delivery speed. For this reason, the sliver deposition problems are significantly greater since the increased centrifugal forces result in a sliver expansion (ballooning) which, however, may be compensated for according to the invention by changing the rpm-lag. For this reason, the measures according to the invention are particularly advantageous in case of a coiler head which has a relatively small diameter, for example, 150–250 mm.

The apparatus according to the invention includes an arrangement for changing the rpm relationships (rpm-lags) between the several drive motors and further, a lag setting device is provided which, upon an alteration of the sliver delivery speed of the sliver-producing machine, automatically sets a changed lag between the separately driven components for advancing the sliver, depositing the sliver in an angular pattern and moving the coiler can platform during the sliver deposition.

The invention has the following additional advantageous features:

- A device for measuring the sliver output speed of the sliver-producing machine is provided.
- A tachometer is connected with an electric control and regulating device (microcomputer) which, upon an alteration of the rpm of the sliver delivering pressure rolls, sets a changed rpm for the coiler head and the speed of the coiler can platform.
- The control and regulating device has a memory in which the relationship between the measured rpm of the pressure rolls and the rpm to be set for the coiler head and the coiler can platform are stored as a function of the sliver delivery speed.
- The change of the speed relationships is non-linear.
- For each drive motor an associated function curve is stored in the memory.
- The control and regulating device emits an electric signal for setting each rpm control device associated with the respective drive motor.
- A separate tachometer is associated with the pressure rolls, the coiler head and the coiler can platform.
- The coiler head has a small diameter of 150–250 mm.

BRIEF DESCRIPTION OF THE DRAWINGS

FIG. 4 is a block diagram of a preferred embodiment of the invention associated with a drawing frame handling flat coiler cans.

FIG. 5 is a top plan view of a cylindrical coiler can containing sliver deposited in an annular pattern.

FIG. 6 is a top plan view of a flat coiler can containing sliver deposited in an annular pattern.

FIG. 7 is a block diagram of an apparatus according to the invention for controlling the rpm of the pressure rolls and the coiler head as a function of the sliver delivery speed.

FIG. 8 is a diagram showing the percentage of lag as a function of the sliver delivery speed.

FIG. 9 is a diagram showing the relationship between the speed of the pressure rolls and the lag percentage.

FIG. 10 is a diagram showing the relationship between the delivery speed and the lag percentage according to the prior art.

DESCRIPTION OF THE PREFERRED EMBODIMENTS

Figure 1:
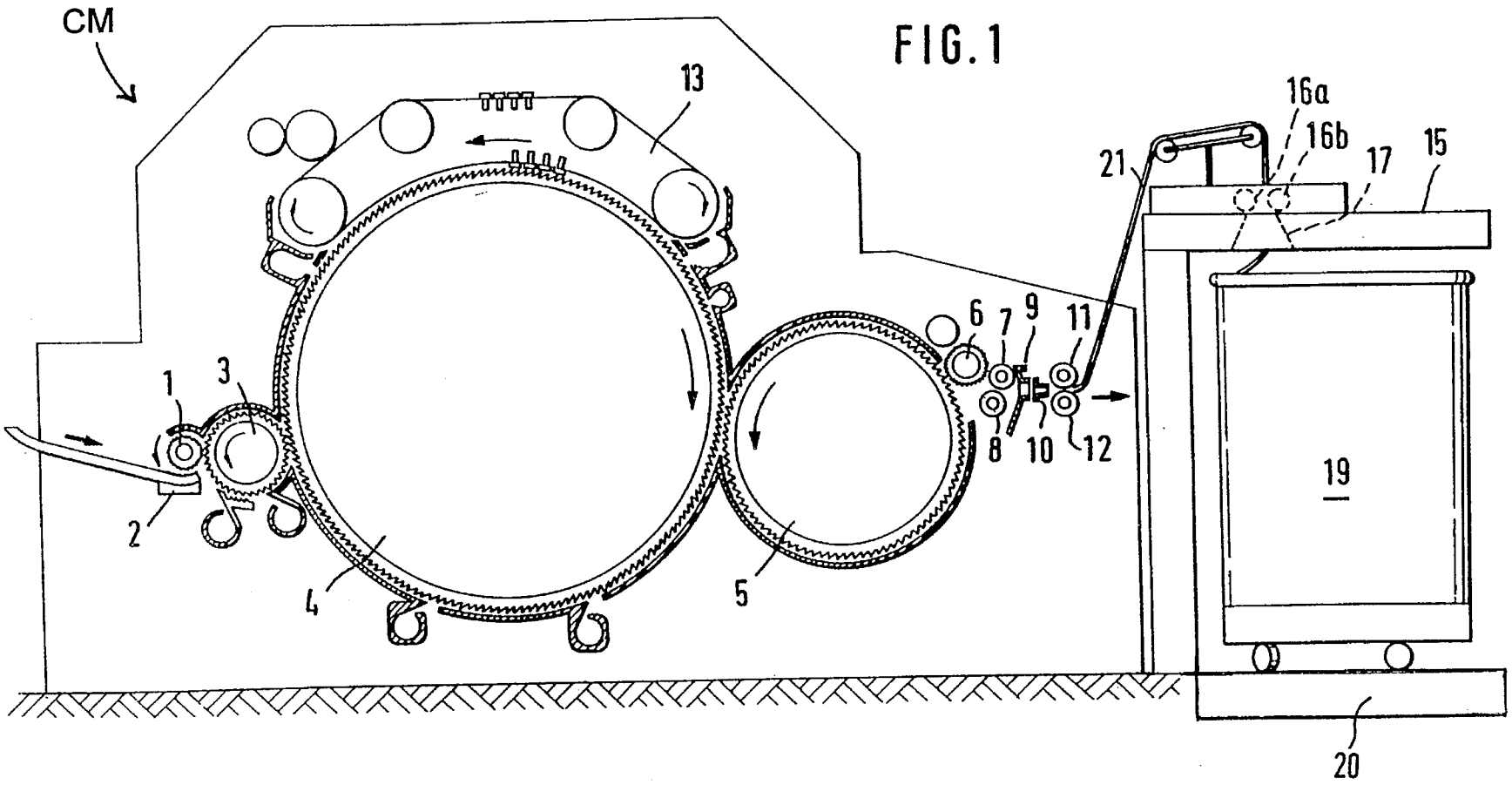
FIG. 1 is a schematic side elevational view of a carding machine incorporating the invention.
Figure 3:
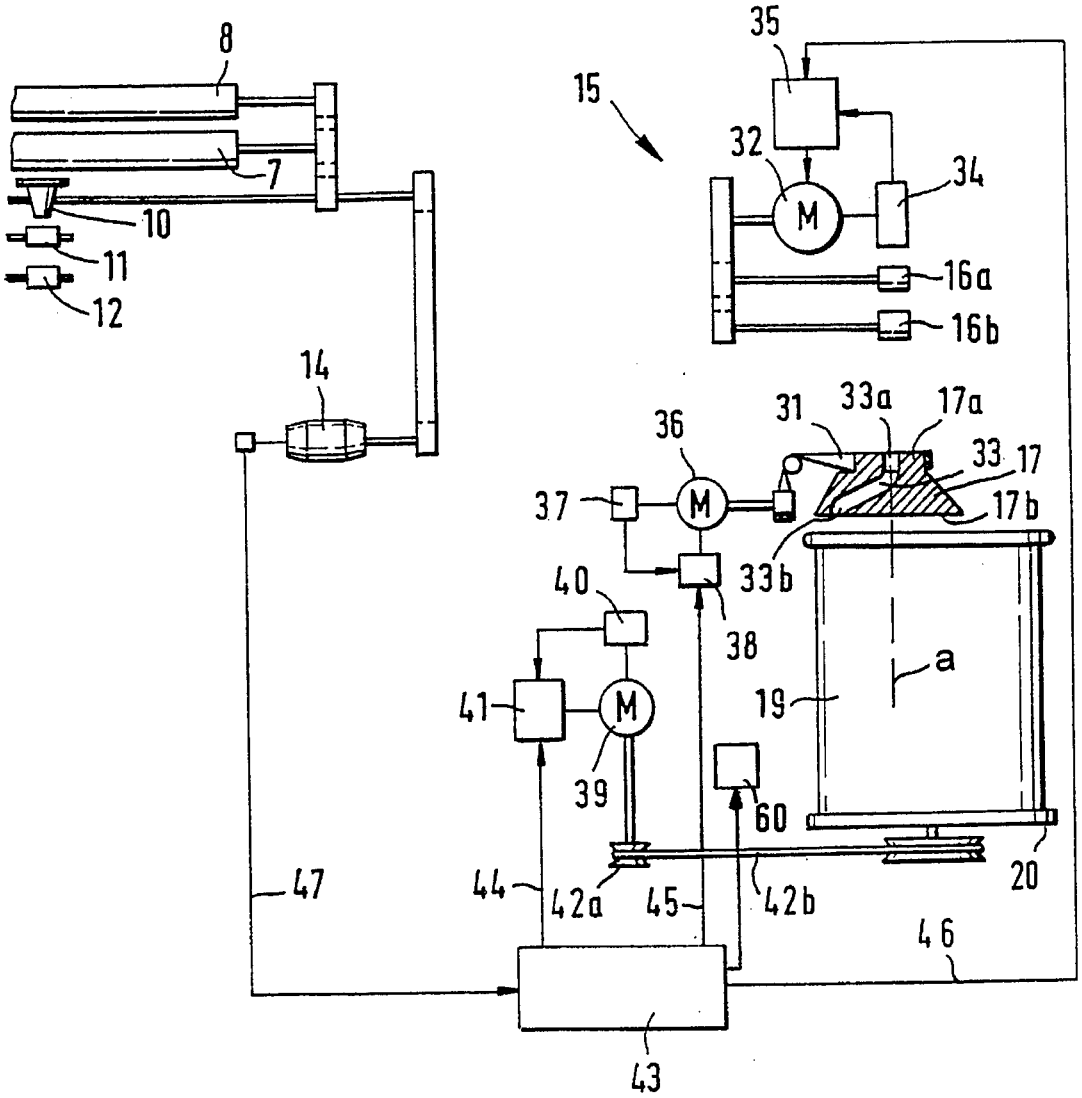
FIG. 3 is a block diagram of a preferred embodiment of the invention associated with a carding machine.

FIG. 1 shows a carding machine CM which may be an EXACTACARD DK 760 model, manufactured by Tr ützschler GmbH & Co. KG, Mönchengladbach, Germany. The carding machine has a feed roll 1, a feed table 2, a licker-in 3, a main carding cylinder 4, a doffer 5, a stripping roll 6, crushing rolls 7 and 8, a web guiding element 9, a sliver trumpet 10, delivery rolls (calender rolls) 11 and 12 as well as traveling flats 13. The delivery rolls 11 and 12, the crushing rolls 7 and 8, the stripping roll 6 and the doffer 5 are driven by a motor 14, as shown in FIG. 3. At the output side of the carding machine CM a sliver coiler 15 is arranged which includes two driven pressure rolls 16*a*, 16*b* and a driven coiler head 17. The cylindrical coiler can 19 is positioned on a driven coiler can platform 20.

Figure 2:
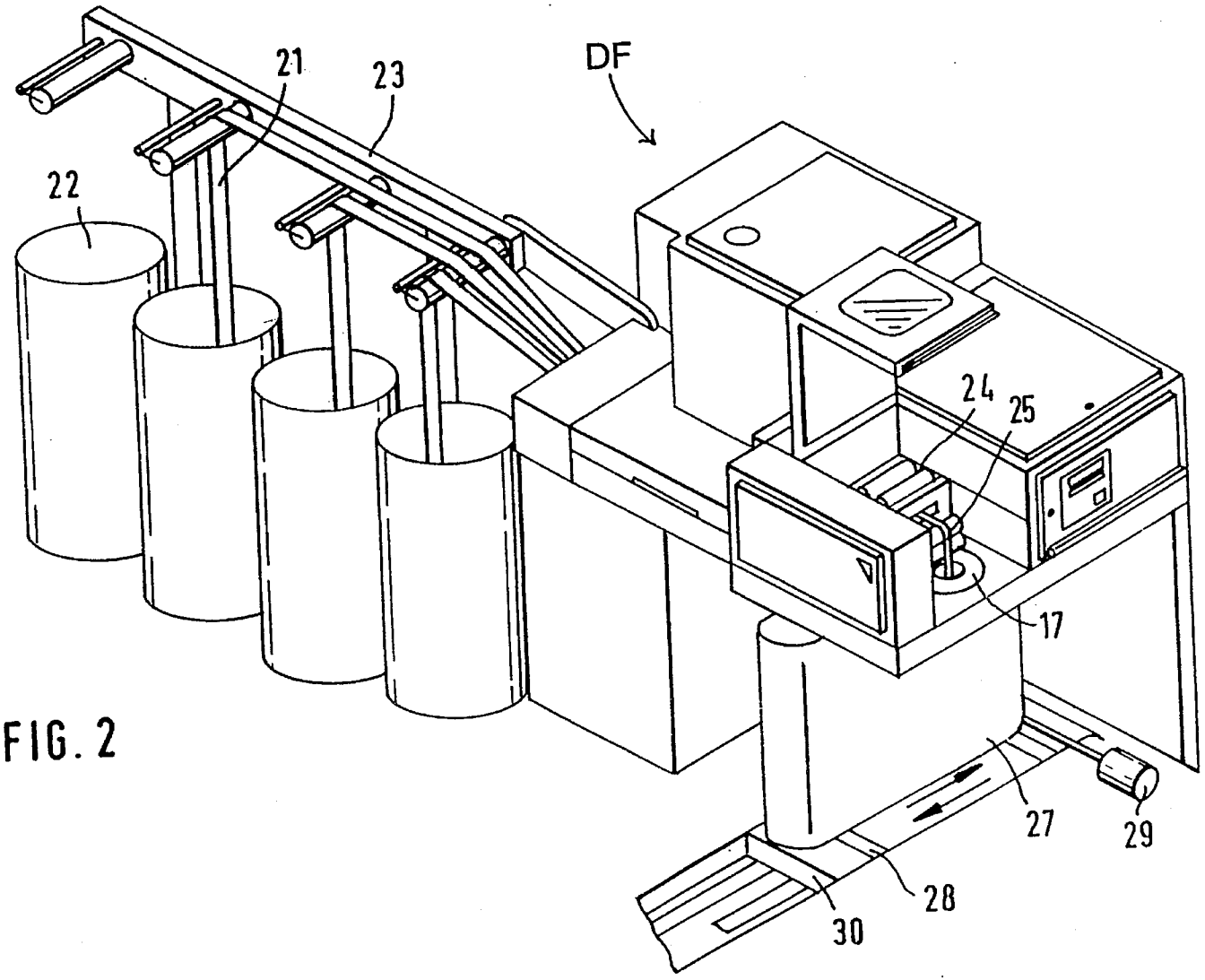
FIG. 2 is a schematic perspective view of a drawing frame incorporating the invention.

FIG. 2 illustrates a drawing frame DF which may be an HS 900 model high-performance drawing frame manufactured by Trützschler GmbH & Co. KG. Underneath the sliver input 23 of the drawing frame DF a plurality of cylindrical (round) coiler cans 22 are arranged and the sliver 21 is drawn from the cans 22 and advanced to the drawing unit 24 of the drawing frame DF. After passing through the drawing unit 24, the drafted sliver 25 is introduced into the coiler head 17 and is deposited thereby in an annular pattern into a flat coiler can 27. The flat coiler can 27 is positioned on a sled 28 which is reciprocated in the direction of the arrows by a shifting device 30 driven by a motor 29.

Turning to FIG. 3, the sliver 21 is advanced to the cooperating pressure rolls (calender rolls) 16*a*, 16*b*. The sliver originates from a sliver-producing spinning preparation machine such as a carding machine CM (FIG. 1) or a drawing frame DF (FIG. 2).

The coiler head 17 is supported for rotation about a vertical axis a and has a belt pulley 17*a* about which a drive belt 31 is trained to provide a driving torque. The coiler head 17 further has a lower plate 17*b* positioned above the coiler can 19 which, in turn, stands on the rotary platform 20. The coiler head 17 has an obliquely oriented sliver channel 33 having an inlet opening 33*a* oriented towards the pressure rolls 16*a*, 16*b* and an outlet opening 33*b* which is situated in the rotary plate 17*b* eccentrically to the vertical axis a of the coiler head 17. The coiler can 19 which may be conventionally provided with a vertically displaceable bottom pressed upwardly by a coil spring, stands on the can platform 20 which is rotatable about a vertical axis coinciding with the axis of the coiler can 19 standing thereon.

The pressure rolls 16*a*, 16*b* are driven by an electric motor 32 which has an rpm transmitter (tachometer) 34 connected to the electric motor 32 by an rpm control device 35. A further electric motor 36 drives the belt 31 to rotate the coiler head 17. The electric motor 36 too, is provided with an rpm transmitter (tachometer) 37 connected to the electric motor 36 by an rpm control device 38. An electric motor 39 drives the coiler can platform 20 by means of a drive pulley 42*a* and a drive belt 42*b*. The electric motor 39 has an rpm transmitter (tachometer) 40 coupled to the electric motor 39 by an rpm control device 41. According to this arrangement all three driving devices have their own rpm regulating circuit respectively formed of the electric motor 32, 36 and 39, the rpm transmitter 34, 37, and 40 as well as the rpm control device 35, 38 and 41.

The desired rpm values 44, 45, and 46 for the drive motors 39, 36 and 32, respectively, are calculated by a central control and regulating device 43 such as a microcomputer. The desired values 44, 45, and 46 are in a predetermined, variable relationship to the delivery speed value 47 of the sliver-producing machine. A conventional sliver severing device 60 is also connected to the control and regulating device to cut the sliver, for example, downstream of the sliver outlet 33*b* of the coiler head 17 when the desired fill level in the coiler can is reached.

When flat coiler cans 27 are used as shown in FIG. 2, they are linearly reciprocated underneath the coiler head 17 by the back-and-forth travelling sled 28.

In FIG. 4 an rpm transmitter 48 and an rpm control device 49 are associated with the drive motor 29 for the reciprocating device 30 of the sled 28 and are connected to the control and regulating device 43. In other respects, the sliver coiler at the outlet end of the drawing frame DF corresponds to the sliver coiler at the output end of the carding machine CM. It should be understood that at the output end of the drawing frame DF the sliver 25 may be deposited in a rotating cylindrical coiler can in which case the can is supported on a rotary platform 20 as shown in FIGS. 1 and 3.

FIGS. 5 and 6 show the annular pattern of the deposited sliver in a cylindrical coiler can 19 (FIG. 5) and in a flat coiler can 27 (FIG. 6).

As illustrated in FIG. 7 the drive motor 32 drives the pressure rolls 16*a*, 16*b*, while the motor 36 drives the coiler head 17. Information (signal 47) is applied from an inputting device 54 to a device 50 of the microcomputer 43 for the sliver delivery speeds. The device 50 is connected with a device 51 for applying the desired rpm signals to the motor 36 of the coiler head 17. The device 50 is also connected with a lag evaluating device 52 which evaluates the sliver delivery speed as illustrated in the diagram of FIG. 8. By comparing with empirically determined curves the optimal lag range belonging to the sliver delivery speed is determined and in the speed transmitting stage 53 the resulting new rpm (FIG. 9) for the pressure rolls 16*a*, 16*b* is calculated.

FIG. 10 illustrates the prior art where the relationship between lag and sliver delivery speed remains constant.

It will be understood that the above description of the present invention is susceptible to various modifications, changes and adaptations, and the same are intended to be comprehended within the meaning and range of equivalents of the appended claims.

What is claimed is:

1. In a method of depositing sliver from a sliver-producing machine into a coiler can, including the steps of outputting the sliver by the sliver-producing machine with a delivery speed;

advancing the sliver to a sliver depositing device with an advancing speed;

positioning an upwardly open coiler can on a platform below the sliver depositing device;

moving the platform with the coiler can with a platform speed; and rotating the sliver depositing device with a rotary speed and discharging the sliver by the sliver depositing device for depositing the sliver into the moving coiler can in an annular pattern;

the improvement comprising the step of automatically varying a lag between said advancing speed, said rotary speed and said platform speed upon a change of said delivery speed.

2. The method as defined in claim 1, wherein the step of varying the lag includes the step of non-linearly varying the lag between said advancing speed, said rotary speed and said platform speed as a function of said delivery speed.

3. The method as defined in claim 1, further comprising the step of storing a separate rpm curve for said first, second and third motor as a function of said delivery speed.

4. An apparatus for depositing sliver from a sliver-producing machine into a coiler can, including means for outputting the sliver by the sliver-producing machine with a delivery speed;

a movable coiler can platform for receiving an upwardly open coiler can thereon;

a sliver advancing device;

a sliver depositing device positioned above the coiler can platform for receiving the sliver from the sliver advancing device and for depositing the sliver into the coiler can in an annular pattern; and first, second and third motors for driving the platform, the sliver advancing device and the sliver depositing device, respectively;

the improvement comprising lag-setting means for automatically changing a speed lag between said first, second and third motors upon a change of the delivery speed.

5. The apparatus as defined in claim 4, further comprising means for measuring the delivery speed.

6. The apparatus as defined in claim 4, wherein said lag-setting means comprises a tachometer generating a signal representing an rpm of said second motor; said lag-setting means including means for setting a changed rpm for said first and third motors as a function of the signal emitted by said tachometer.

7. The apparatus as defined in claim 4, wherein said lag-setting means includes a memory receiving data on a relationship between a measured rpm of said second motor and the rpm's to be set for said first and third motors.

8. The apparatus as defined in claim 4, further comprising a separate rpm control device connected to said first, second and third motors and means in said lag-setting means for applying signals to the rpm control devices.

9. The apparatus as defined in claim 4, further comprising separate tachometers connected to said first, second and third motors for generating signals representing rpm's thereof.

10. The apparatus as defined in claim 4, wherein said sliver depositing device comprises a coiler head having a diameter between 150 and 250 mm.

* * * * *